US010440476B2

(12) United States Patent
Wahlin et al.

(10) Patent No.: US 10,440,476 B2
(45) Date of Patent: Oct. 8, 2019

(54) HEADBAND FOR A PAIR OF HEADPHONES, A CORRESPONDING PAIR OF HEADPHONES AND A METHOD OF PROVIDING THE HEADBAND

(71) Applicant: Zound Industries International AB, Stockholm (SE)

(72) Inventors: Erik Wahlin, Lidingö (SE); Erik Petersén, Johanneshov (SE)

(73) Assignee: Zound Industries International AB, Stockholm (SE)

( * ) Notice: Subject to any disclaimer, the term of this patent is extended or adjusted under 35 U.S.C. 154(b) by 0 days.

(21) Appl. No.: 15/577,499

(22) PCT Filed: Jun. 16, 2016

(86) PCT No.: PCT/SE2016/050590
§ 371 (c)(1),
(2) Date: Nov. 28, 2017

(87) PCT Pub. No.: WO2017/003346
PCT Pub. Date: Jan. 5, 2017

(65) Prior Publication Data

US 2018/0146292 A1 May 24, 2018

(30) Foreign Application Priority Data

Jun. 29, 2015 (SE) ..... 1550901-1

(51) Int. Cl.
*H04R 5/033* (2006.01)
*H04R 1/10* (2006.01)

(52) U.S. Cl.
CPC ..... *H04R 5/0335* (2013.01); *H04R 1/1008* (2013.01); *H04R 1/1033* (2013.01)

(58) Field of Classification Search
CPC .... H04R 1/10; H04R 2205/022; H04R 1/105; H04R 5/0335; H04R 2201/10
(Continued)

(56) References Cited

U.S. PATENT DOCUMENTS 2,395,356 A 2/1946 Thompson
2,954,442 A * 9/1960 Mickenberg ..... H04R 5/0335 2/209

(Continued)

FOREIGN PATENT DOCUMENTS

CN 101374365 A 2/2009
CN 101489166 A 7/2009

(Continued)

*Primary Examiner* — Suhan Ni
(74) *Attorney, Agent, or Firm* — Knobbe Martens Olson & Bear LLP

(57) ABSTRACT

The present disclosure generally relates to the field of headphones. A pair of headphones (200) may have a headband (210) comprising a flexible elongated strip (211) and a rigid leg (220) such as a spring wire. The elongated strip (211) may have a first end (211*a*) attached to a first earpiece (230*a*) and a second end (211*b*) attached to a second earpiece (230*b*). Furthermore, the elongated strip (211) is configured to extend in a curvature from the first end (211*a*) to the second end (211*b*) to form an arced strip (211) which is configured to extend along a portion of a head of a user of the pair of headphones (200). The leg (220) abuts against the elongated strip (211) and further extends along the elongated strip (211) from the first end (211*a*) to the second end (211*b*). Moreover, the leg (220) may advantageously be positioned along a center portion of the elongated strip (211). For example, the elongated strip (211) may comprise a groove (250) which extends from the first end (211*a*) to the second end (211*b*) and wherein the leg (220) is inserted in the groove.

20 Claims, 10 Drawing Sheets

(58) Field of Classification Search
USPC ..... 381/370, 377–378, 379, 383
See application file for complete search history.

(56) References Cited

U.S. PATENT DOCUMENTS

| | | | | |
|---|---|---|---|---|
| 3,031,539 | A * | 4/1962 | Schuster | G06F 19/00 381/378 |
| 3,119,904 | A * | 1/1964 | Anson | H04M 1/05 15/244.1 |
| 3,190,974 | A * | 6/1965 | Vasicek | H04M 1/05 248/298.1 |
| 4,499,593 | A | 2/1985 | Antle | |
| 4,588,868 | A | 5/1986 | Bertagna et al. | |
| 6,449,806 | B1 | 9/2002 | Engelhard et al. | |
| 8,363,875 | B2 | 1/2013 | Ito et al. | |
| 8,737,668 | B1 | 5/2014 | Blair et al. | |
| 8,913,772 | B2 | 12/2014 | Yamaguchi et al. | |
| 9,380,376 | B2 | 6/2016 | Uggla | |
| 2006/0147052 | A1 | 7/2006 | Wikel et al. | |
| 2014/0348371 | A1 * | 11/2014 | Ishizaki | H04R 5/0335 381/378 |

FOREIGN PATENT DOCUMENTS

| | | |
|---|---|---|
| DE | 29905370 | 7/2000 |
| EP | 2566191 | 3/2013 |
| EP | 2887693 | 6/2015 |
| GB | 216650 | 6/1924 |
| SE | 537 776 | 10/2015 |
| WO | WO 2001/054131 | 7/2001 |

* cited by examiner

HEADBAND FOR A PAIR OF HEADPHONES, A CORRESPONDING PAIR OF HEADPHONES AND A METHOD OF PROVIDING THE HEADBAND

CROSS REFERENCE TO RELATED APPLICATIONS

This application is a U.S. National Phase Application of PCT International Application Number PCT/SE2016/050590, filed on Jun. 16, 2016, designating the United States of America and published in the English language, which claims the benefit of priority to Sweden Patent Application Number SE1550901-1, filed on Jun. 29, 2015. The disclosures of the above-referenced applications are hereby expressly incorporated by reference in their entireties.

TECHNICAL FIELD

The present disclosure generally relates to the field of headphones. The embodiments of the present invention relate to a headband for a pair of headphones, a corresponding pair of headphones and a method of providing the headband.

BACKGROUND

Headphones are known in the art. FIG. 1 shows an example of a pair of headphones 100. In the existing art, the pair of headphones 100 typically comprises a headband 110. Typically, but not necessarily, the headband 110 is an arced headband. The headband 110 is generally configured to extend along a portion of a head of a user, or wearer, of the pair of headphones 100. Each headband end 120 is provided with a respective earpiece 130. Each of the two earpieces 130 comprises respective speaker elements, etc. (not shown), as is conventional and known in the existing art. The earpieces 130 also provide a volume around (or at) the ears of the user such that the pair of headphones 100 may be worn conveniently by the user and such that the sound listening experience is satisfactory when using the pair of headphones 100.

In order to provide a sound listening experience that is satisfactory when using a pair of headphones of the type shown in FIG. 1, the two earpieces 130 should typically press sufficiently towards the ears of the user (or, the areas of the head which are proximate to the respective ears), during use. This force, i.e. the force with which the earpieces 130 press against the ears of the user during use, is sometimes referred to as the clamp force. This clamp force may also be important to allow for the pair of headphones 100 to stay in place on the head of the user, when in use. Additionally, the clamp force may be important to enable the sealing of the sound when the earpieces 130 are provided around (or at) the ears of the user. At the same time, it is recognized that it may be equally important that the pair of headphones 100 can be worn conveniently. In order to allow for headphones 100 that can be worn conveniently, it is becoming increasingly important to allow for personalized headphones which can be adjusted to different sizes and/or shapes of users' heads.

SUMMARY

It is in view of the above considerations and others that the various embodiments of the present invention have been made.

It is a general object to provide a headband which is easy to adjust according to the size of a user's head and which, at the same time, will adjust itself to the shape of a user's head. This general object has therefore been addressed by the appended independent claim 1. Advantageous embodiments are defined in the appended dependent claims 2-16.

According to a first aspect, a headband for a pair of headphones is therefore provided. The headband comprises an elongated strip made of a flexible material. This elongated strip comprises a first end configured to be attached to a first earpiece and a second end configured to be attached to a second earpiece. Furthermore, the elongated strip is configured to extend in a curvature from the first end to the second end to form an arced strip. This arced strip is configured to extend along a portion of a head of a user of the pair of headphones. The headband also comprises a leg made of a rigid material. The leg abuts against the elongated strip and extends along the elongated strip from the first end to the second end.

The leg may advantageously, but not necessarily, be positioned along a center portion of the elongated strip.

The provision of a rigid leg abutting against a flexible elongated strip (preferably in a center portion thereof) has the combined effect of 1) enabling a sufficient clamp force to allow for pressing two earpieces properly against the ears of the user (in use) and, at the same time, 2) enabling a rotational movement of the elongated strip around the leg which in turn allows for a suitable adjustment to a user's head. In turn, this may provide a more comfortable and pleasant experience when using a pair of headphones. Additionally, this disclosure recognizes the fact that the rotational movement makes it possible to adapt to the angles of the ears. In turn, this makes the headband ambidextrous and the headband can adapt to the left as well as the right ear of a user.

In an advantageous embodiment, the elongated strip comprises a groove (or, recess) which extends from the first end to the second end. The leg is insertable in this groove. Thus, the leg can be inserted in the groove.

Furthermore, one or several snap connections may optionally be provided along the groove e.g. to facilitate insertion of the leg in the groove. In some embodiments, the leg is displaceable in a longitudinal direction of the elongated strip at each of the first and second ends such that the leg is fee to move back and forth within the respective end. Furthermore, the groove may optionally comprise a stop member at each end of the groove. The provision of a groove (or, recess) in which the leg can be inserted is advantageous because the manufacturing of the headband can be simplified. Hence, the manufacturing of the headband can also be relatively inexpensive.

In an alternative embodiment, the leg is instead irremovably attached to the elongated strip. For example, the leg may be attached to the elongated strip by means of an adhesive, such as glue.

In yet another alternative embodiment, the leg is enclosed by the flexible elongated strip. For example, this could be achieved by an injection molding process, during which process the leg is enclosed by the flexible elongated strip. In some embodiments, the elongated strip may for example comprise a tubular leg receiving means (or, tube) wherein the leg is inserted into said tubular leg receiving means.

In some embodiments, a plurality of tubular section parts may provided along a groove of the elongated strip. For example, the elongated strip may comprise alternately reoccurring tubular section parts that collectively form a regular pattern along the groove.

Typically, but not necessarily, the above-mentioned leg may be a spring wire. Advantageously, the spring wire may have a diameter of 1.6-2.2 millimeters, and preferably 1.8-2.0 millimeters. The spring wire may e.g. comprise a metal or a metal alloy. In some embodiments, the spring wire may be made of a steel alloy. In alternative embodiments, the spring wire may be made of an aluminum alloy. Additionally, or alternatively, the spring wire may comprise glass fiber. For example, the spring wire could be made of glass fiber and titanium. Additionally, or alternatively, the spring wire may comprise carbon fiber.

Typically, but not necessarily, the above-mentioned elongated strip is made of a polymer material.

The elongated strip may, for example, comprise any one or a combination of the following materials: polyamide (PA), polycarbonates (PC), polyethylene (PE), high-density polyethylene (HDPE), polyethylene terephthalate (PTE), polyvinyl chloride (PVC), polypropylene (PP), thermoplastic elastomer (TPE), thermoplastic polyurethane (TPU), and acrylonitrile butadiene styrene (ABS).

It is another general object to provide a pair of headphones which is easy to adjust according to the size of a user's head and which, at the same time, will adjust itself to the shape of a user's head. This general object has therefore been addressed by the appended claim 17. An advantageous embodiment is further defined in appended claim 18.

According to a second aspect, a pair of headphones is therefore provided. The pair of headphones comprises a headband according to the first aspect, wherein the first end is attached to a first earpiece and the second end is attached to a second earpiece. In other words, there is a provided pair of headphones comprising a headband, wherein the headband comprises:

an elongated strip made of a flexible material, wherein the elongated strip comprises a first end attached to a first earpiece and a second end attached to a second earpiece, and wherein the elongated strip is configured to extend in a curvature from the first end to the second end to form an arced strip which is configured to extend along a portion of a head of a user of the pair of headphones; and a leg made of a rigid material, the leg abutting against the elongated strip and extending along the elongated strip from the first end to the second end and wherein the leg is preferably (but not necessarily) positioned along a center portion of the elongated strip.

In an advantageous embodiment, the elongated strip comprises a groove (or, recess) which extends from the first end to the second end of the elongated strip. The leg is insertable in this groove. In other words, the leg can be inserted in the groove.

In an advantageous embodiment, the first end is attached to a first earpiece by means of a first pivot hinge and the second end is attached to the second earpiece by means of a second pivot hinge. Each pivot hinge may comprise a recess (or, notch) configured to receive an audio cable such that the audio cable can extend from the first earpiece along the strip to the second ear piece.

It is still another general object to provide a simplified method of providing a headband for a pair of headphones. This general object has therefore been addressed by the appended claim 19.

According to a third aspect, a method of providing a headband for a pair of headphones is therefore provided. The method comprises providing an elongated strip made of a flexible material, wherein the elongated strip comprises a first end configured to be attached to a first earpiece and a second end configured to be attached to a second earpiece, and wherein the elongated strip extends in a curvature from the first end to the second end to form an arced strip which is configured to extend along a portion of a head of a user of the headband; providing one leg made of a rigid material; and engaging the leg with the elongated strip such that leg abuts to the elongated strip and such that the leg extends along the elongated strip from the first end to the second end and is further preferably (but not necessarily) positioned along a center portion of the elongated strip.

In an advantageous embodiment, the elongated strip comprises a groove which extends from the first end to the second end. If so, the step of engaging the leg with the elongated strip comprises inserting the leg in the groove of the elongated strip.

BRIEF DESCRIPTION OF THE DRAWINGS

These and other aspects, features and advantages will be apparent and elucidated from the following description of various embodiments, reference being made to the accompanying drawings, in which.

DETAILED DESCRIPTION OF EMBODIMENTS

The present invention will now be described more fully hereinafter. The invention may, however, be embodied in many different forms and should not be construed as limited to the embodiments set forth herein; rather, these embodiments are provided by way of example so that this disclosure will be thorough and complete, and will fully convey the scope of the invention to those persons skilled in the art. Like reference numbers refer to like elements throughout the description.

With reference to FIGS. 2 through 6, a headband 210 for a pair of headphones 200 in accordance with an embodiment will be described in detail.

The headband comprises an elongated strip 211 of flexible (or, pliable) material. For example, the elongated strip 211 may be made of a polymer material. The elongated strip 211 may, for instance, comprise one or several of the following example materials: polyamide (PA), polycarbonates (PC), polyethylene (PE), high-density polyethylene (HDPE), polyethylene terephthalate (PTE), polyvinyl chloride (PVC), polypropylene (PP), thermoplastic elastomer (TPE), thermoplastic polyurethane (TPU) and acrylonitrile butadiene styrene (ABS).

The elongated strip 211 comprises a first end 211*a* configured to be attached to a first earpiece 230*a*. In other words, the first end 211*a* is configured to be removably (or, alternatively, irremovably) attached to the first earpiece 230*a*. The elongated strip 211 also comprises a second end 211*b* configured to be attached to a second earpiece 230*b*. In other words, the second end 211*b* is configured to be removably (or, alternatively, irremovably) attached to the first earpiece 230*b*. Advantageously, but not necessarily, the first end 211*a* may be attached to the first earpiece 230*a* by means of a first pivot hinge 240*a*. Likewise, the second end 211*b* may be attached to the second earpiece 230*b* by means of a second pivot hinge 240*b*. Each pivot hinge may additionally comprise a recess 241*b* (see FIG. 4A), or notch, configured to receive an audio cable such that the audio cable can extend from the first earpiece 230*a* along the elongated strip 211 to the second ear piece 230*b*.

Figure 1:
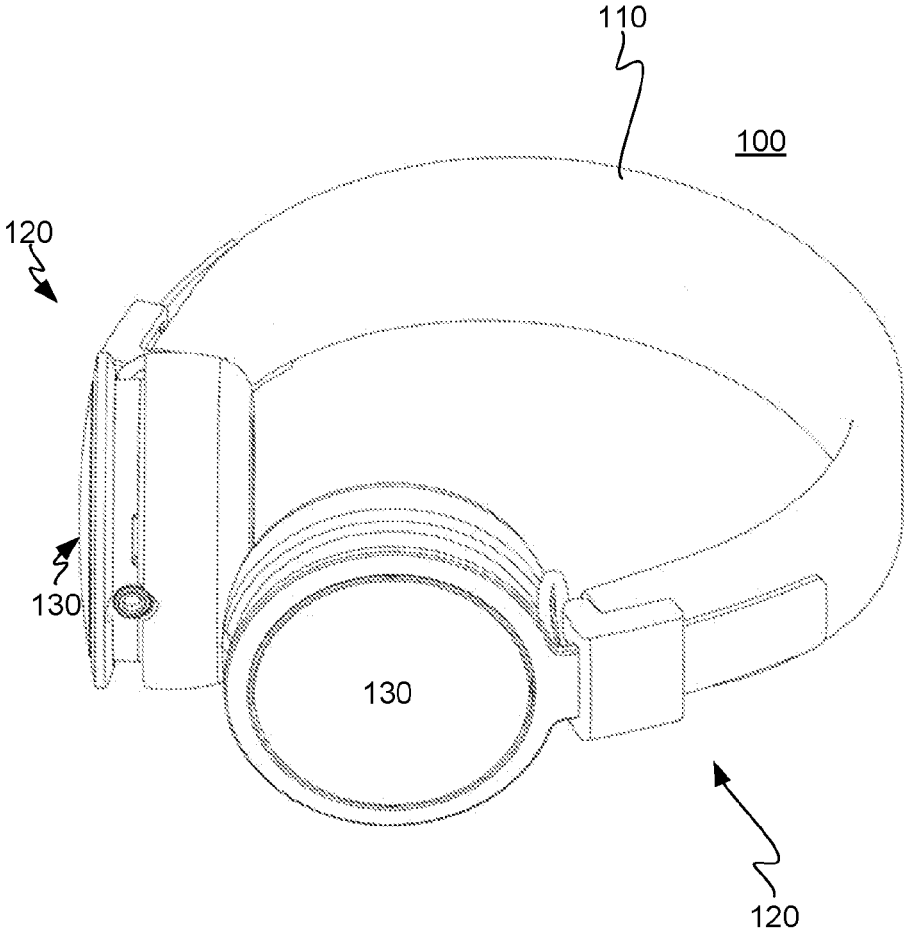
FIG. 1 shows a perspective view of a pair of headphones.
Figure 2C:
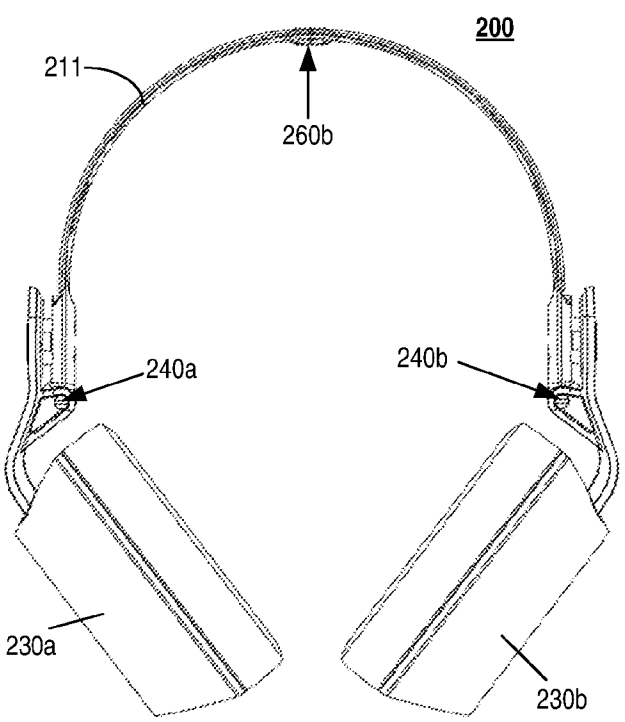
FIG. 2C is a front view of the pair of headphones illustrated in FIGS. 2A and 2B.
Figure 2B:
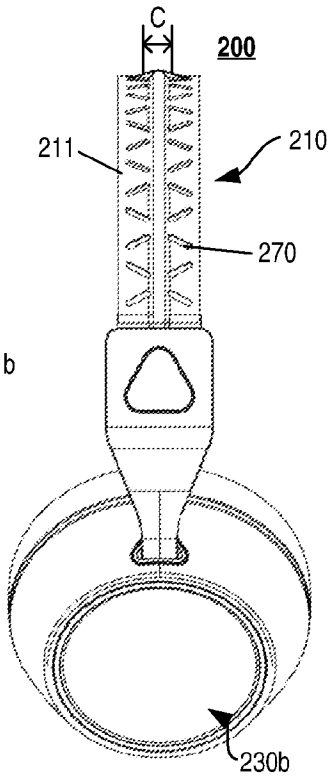
FIG. 2B is a side view of the pair of headphones illustrated in FIG. 2A.
Figure 2A:
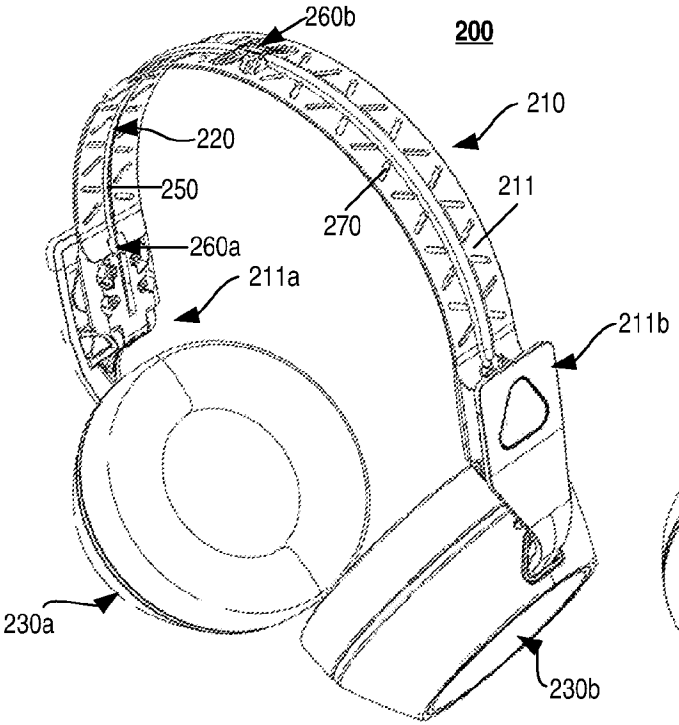
FIG. 2A schematically illustrates an isometric view of a pair of headphones, in accordance with an embodiment.
Figure 3:
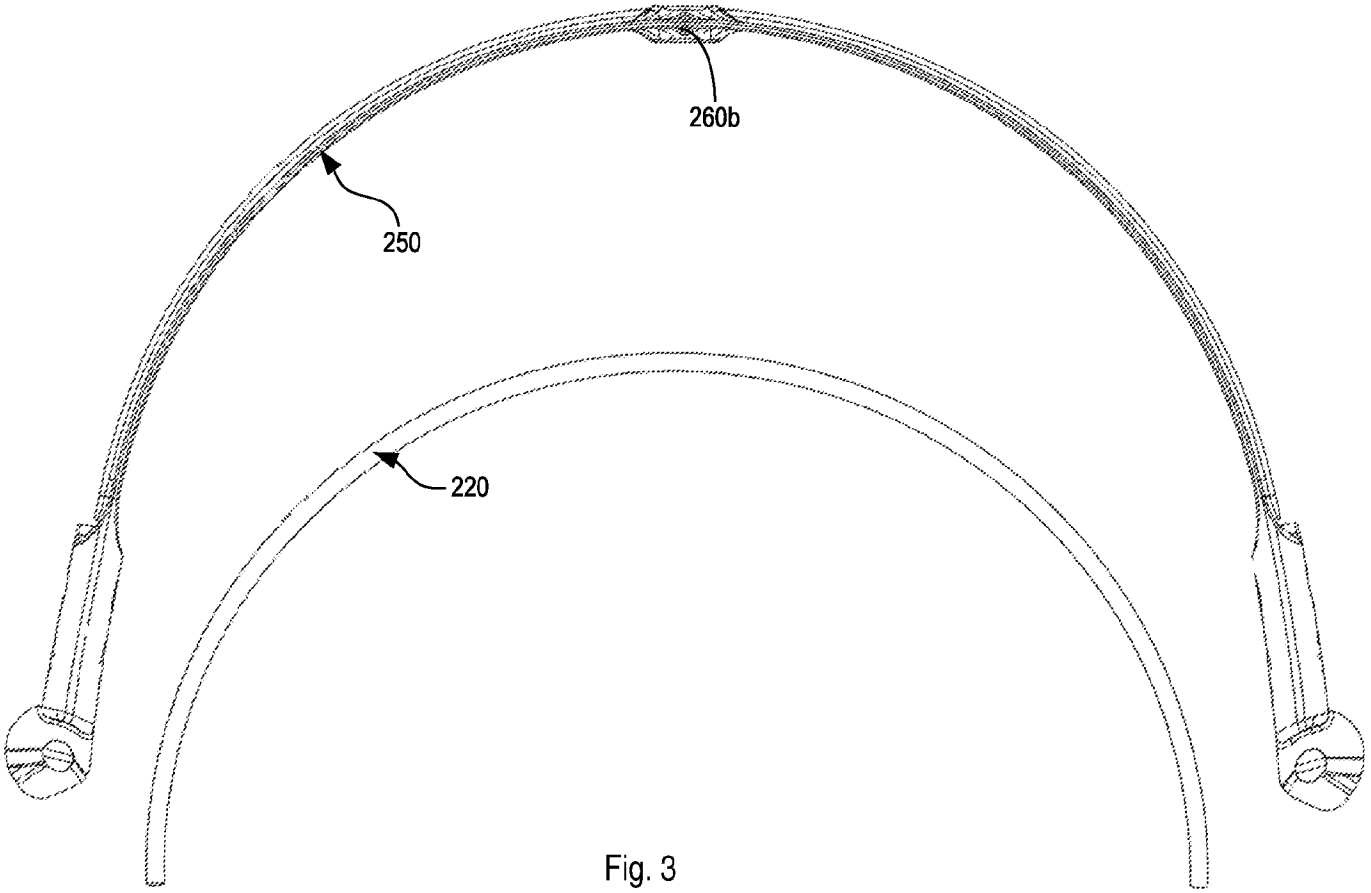
FIG. 3 is a front view of a headband and a leg of the pair of headphones illustrated in FIGS. 2A-2C.
Figure 4B:
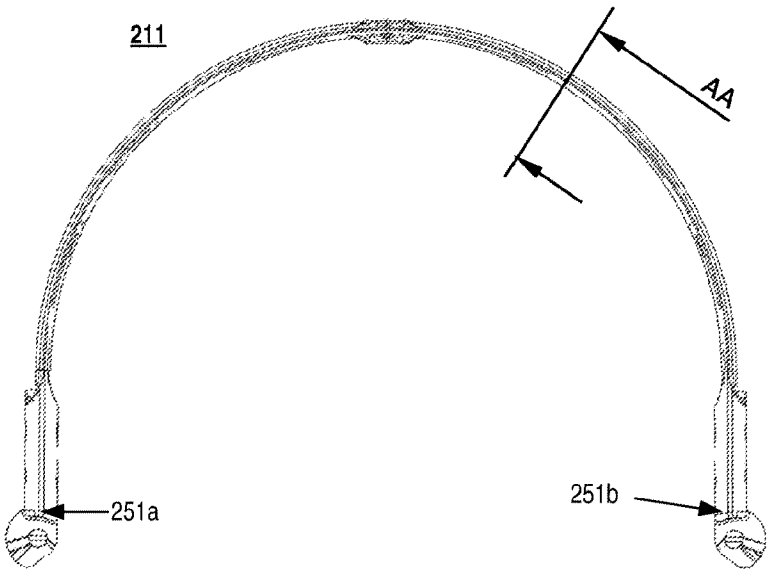
FIG. 4B is a front view of the headband illustrated in FIG. 4A.
Figure 4A:
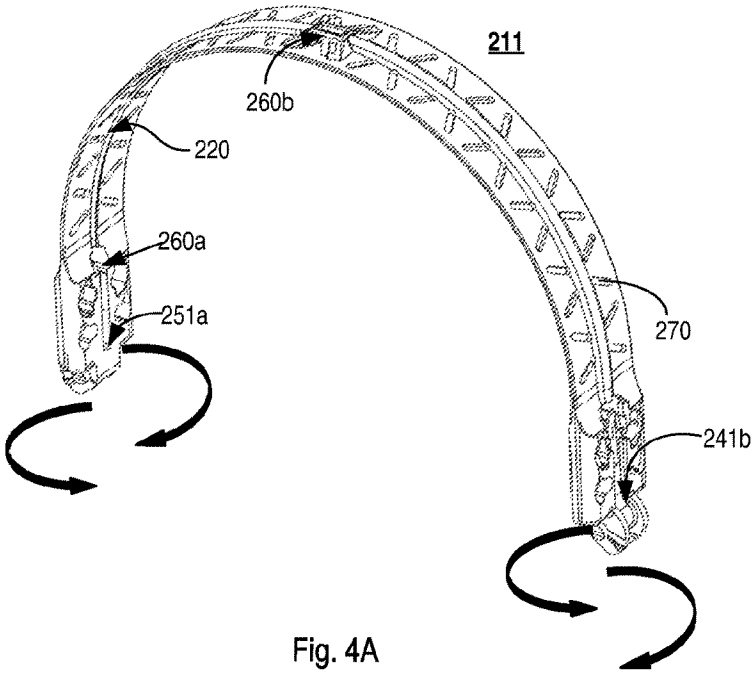
FIG. 4A schematically illustrates an isometric view of the headband of the pair of headphones shown in FIGS. 2A-2C.
Figure 5:
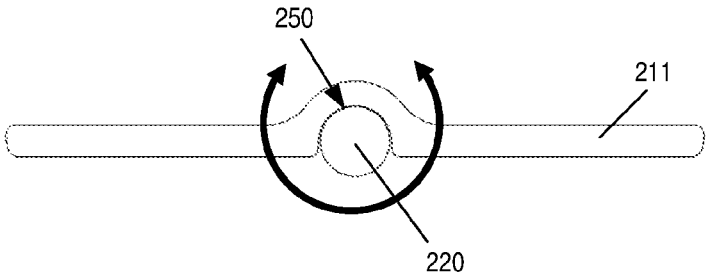
FIG. 5 is an enlarged side view at cross section AA, as illustrated in FIG. 4B.
Figure 6:
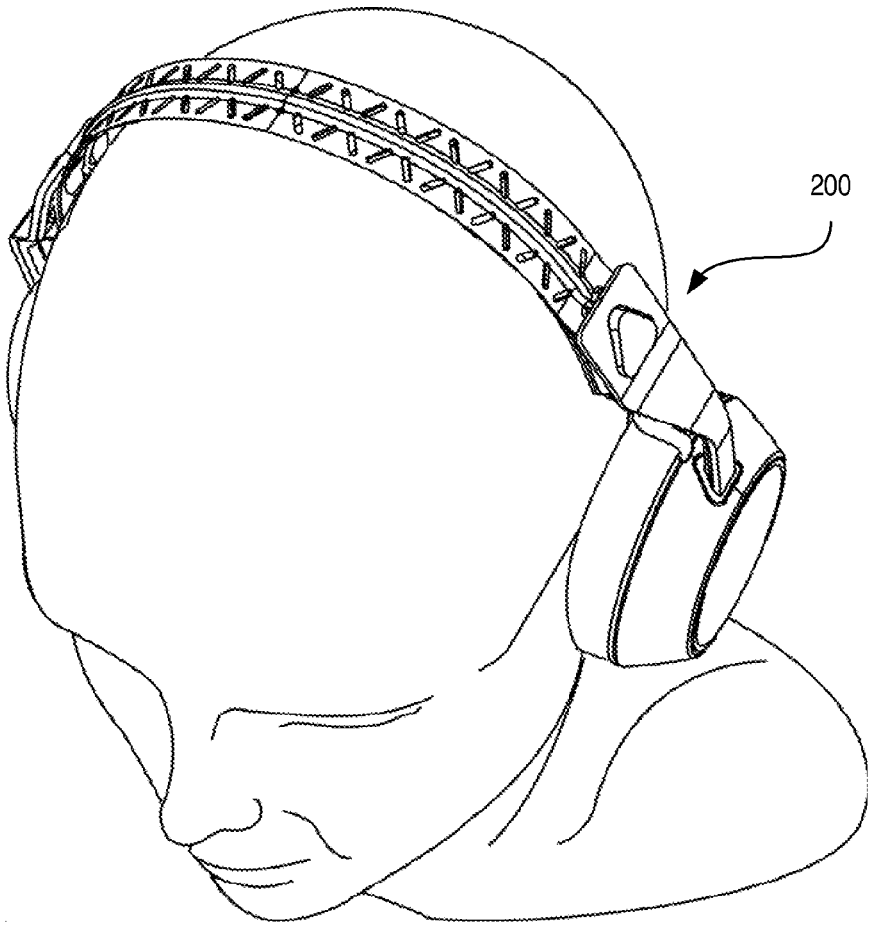
FIG. 6 schematically illustrates a user wearing a pair of headphones as illustrated in FIG. 2A.

As can be seen in the FIGS. 2 through 6, the elongated strip 211 is configured to extend in a curvature from the first end 211*a* to the second end 211*b* to form an arced strip, which is configured to extend along a portion of a head of a user (see e.g. FIG. 6).

Furthermore, a leg 220 made of a rigid material is provided. In the embodiment illustrated in FIGS. 2 through 5, the leg 220 is exemplified by a spring wire. As can be seen in FIGS. 2 through 5, the leg 220 is generally abutting against the elongated strip 211. The leg 220 also extends along the elongated strip 211 from the first end 211*a* thereof to the second end 211*b* thereof. Hence, the leg 220 also extends in a curvature from the first end 211*a* to the second end 211*b* to form an arced leg 220. The arced leg 220 is also configured to extend along a portion of a head of a user.

In order to allow for a proper rotation of the elongated strip 211 around the leg 220, the leg 220 is advantageously positioned along a center portion C of the elongated strip 211. While it is preferred to position the leg 220 along the center portion C of the elongated strip 211, a person skilled in the art would appreciate that it is not necessary to position the leg 220 at the exact center of the elongated strip 211. A certain deviation from the exact center of the elongated strip 211 is of course possible to achieve the same or similar effects with respect to the rotation of the flexible elongated strip 211 around the comparatively more rigid leg 220.

Advantageously, the spring wire shown in FIGS. 2 through 5 has a diameter of 1.6-2.2 millimeters, and preferably 1.8-2.0 millimeters. The spring wire may e.g. comprise a metal or a metal alloy. In some embodiments, the spring wire may be made of a steel alloy. In alternative embodiments, the spring wire may be made of an aluminum alloy. Additionally, or alternatively, the spring wire may comprise glass fiber. For example, the spring wire could be made of glass fiber and titanium. Additionally, or alternatively, the spring wire may comprise carbon fiber.

With continued reference to FIGS. 2-5, it should be appreciated that the elongated strip 211 may advantageously be provided with a groove 250, or recess, for receiving the leg 220. The groove 250 may extend from the first end 211*a* to the second end 211*b* and the leg 220 can be inserted into the groove 250. In some embodiments, the groove 250 may advantageously, but not necessarily, be positioned at an inner surface of the elongated strip 211 such that the leg 220 is configured to face, or abut, a portion of a head of a user when the user wears the pair of headphones 200.

Advantageously, one or several snap connections 260*a-c* may also be provided along the groove 250 to facilitate insertion of the leg 220 in the groove 250. The one or several snap connection 260*a-c* may also allow for the leg 220 to maintain its position in the groove 250 during use. The one or several snap connection can thus eliminate the risk that the leg 220 would slip, or fall, out from the groove 250 during use.

In order to further facilitate the rotation of the flexible elongated strip 211 around the comparatively more rigid leg 220, the leg 200 may advantageously be displaceable in a longitudinal direction of the elongated strip 211 (i.e., at the end portions within the groove 250, in which the leg 220 rests) at each of the first and second ends 211*a*, 211*b* such that the leg 220 is fee to move back and forth within the respective end 211*a*, 211*b*.

In order to limit the movement in said longitudinal direction, the groove 250 may optionally also comprise stop members 251*a*, 251*b* at each end of the groove 250. The stop member 251*a*, 251*b* may e.g. be provided by dead ends of the groove 250. An advantage with dead ends is that these are relatively easy to provide, or manufacture and hence the provision, or manufacturing, of these dead ends is also relatively inexpensive.

The provision of a rigid leg 220 abutting against a flexible elongated strip (e.g., in a center portion thereof) inter alia has the effect of enabling a sufficient clamp force to allow for pressing the two earpieces 230*a*, 230*b* properly against the ears of the user, when in use. At the same, and as can be seen in e.g. FIG. 4A, this construction of the headband 210 also enables a rotational movement of the elongated strip 211 around the leg 220 which in turn allows for a suitable adjustment to a user's head. In turn, this may provide a more comfortable and pleasant experience when using of a pair of headphones.

Although advantageous embodiments of the invention have been described with reference to FIGS. 2 through 5 hereinabove, modifications and other variants of the described embodiments will come to mind to one skilled in the art having benefit of the teachings presented hereinabove. For example, instead of providing a leg 220 (e.g. a spring wire) in a groove 220 it is equally possible to provide a leg which is instead attached to the elongated strip. The leg could e.g. be attached to the elongated strip by means of an adhesive, such as glue. Still another option is to provide a leg, which is instead enclosed by the flexible elongated strip. Furthermore, the leg 220 has been exemplified by a spring wire so far in this disclosure. However, a person skilled in the art would readily appreciate that this spring wire could equivalently be replaced by a strip of rigid material. For example, such a rigid strip may be a generally flat strip. Such a flat strip may have a width which is considerably narrower than the corresponding width of the earlier-mentioned elongated strip 211 made of the flexible material. As a mere example, it would be conceivable to provide a flat strip of rigid material having a width of approximately 20% of the corresponding width of the elongated strip 211, which is made of the flexible material. Persons skilled in the art would also recognize that the cross-section of a spring wire may take different shapes. While a circular cross-section may be advantageous, rectangular or oval cross-sections may be equally possible. Still further, while the embodiments described with respect to FIGS. 2 through 6 suggest the provision of one single leg 220, it should be appreciated that more than one leg could be provided. For example, two or three legs could run in parallel along the elongated strip 211, i.e. from the first end 211*a* to the second end 211*b*. In order to allow for a proper rotation of the flexible elongated strip 211 around the plurality of the comparatively more rigid legs, the two or three legs would preferably have relatively short widths or diameters (e.g., 0.4-0.8 millimeters each) and, also, be positioned relatively close to each other at a center portion of the elongated strip 211.

In some embodiments, a user may wear a pair of headphones such as illustrated in FIG. 6. In alternative embodiments, a headband cover may be irremovably attached to, or folded around, the headband 210. In yet other embodiments, an interchangeable headband cover may be removably attached to, or folded around, the headband 210. For example, the interchangeable headband cover may be of a type disclosed in the Swedish Patent Application no. 1450950-9, filed on Aug. 15, 2014 and entitled "A headband cover for a headband of a headphone" (now Swedish Patent No. 537 776). To this end, an interchangeable headband cover for detachable attachment to the headband 210 may be provided. The interchangeable headband cover may, for example, comprise: a first headband cover unit; a second headband cover unit, which is arranged along a first longitudinal side of the first headband cover unit; and a third headband cover unit, which is arranged along a second longitudinal side of the first headband cover unit, the second longitudinal side being an opposite side to the first longitudinal side; wherein the second headband cover unit is foldable along the first longitudinal side of the first headband cover unit and the third headband cover unit is foldable along the second longitudinal side of the first headband cover unit such that the second and third headband units can be folded around the headband 210 of the pair of headphones 200 to detachably attach the headband cover to the headband 210 of the pair of headphones 200.

As can be seen in the FIGS. 2 through 6, the elongated strip 211 may optionally also be provided with through slots 270 along its length from the first end 211*a* to the second end 211*b*. This may allow for an improved flexibility of the elongated strip 211, which in turn may facilitate the rotational movement around the leg 220 even further. Also, the plurality of through slots 270 may allow for reducing the weight of the headband 210. In turn, this may allow for a lightweight headband 210.

Figure 7A:
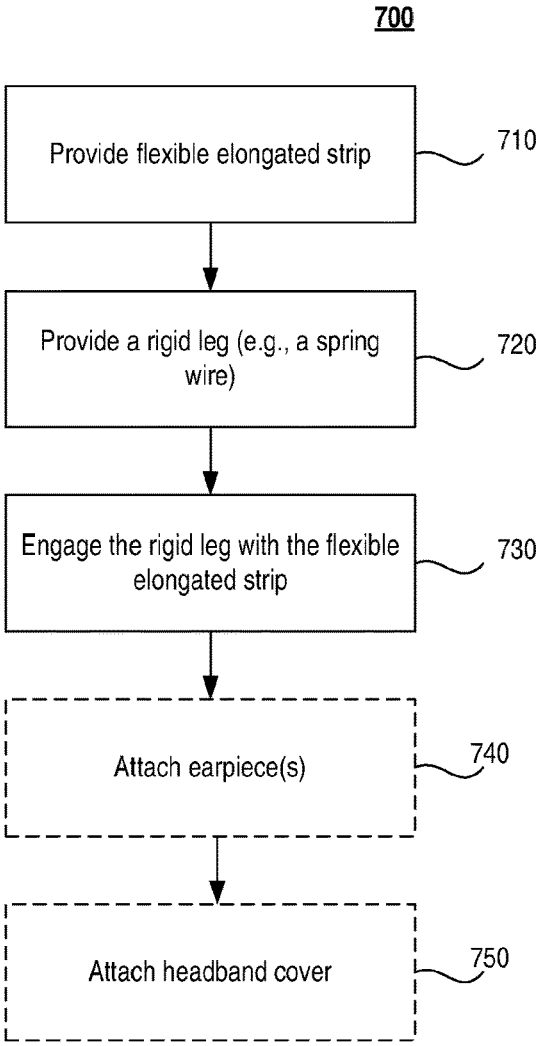
FIG. 7A is a flowchart of method of providing a headband for a pair of headphones, in accordance with an embodiment.

Turning now to FIG. 7A, a method 700 of providing a headband 210 for a pair of headphones 200 will be described.

Action 710: An elongated strip made of a flexible material is provided. As described earlier, the elongated strip comprises a first end configured to be attached to a first earpiece and a second end configured to be attached to a second earpiece. Furthermore, the elongated strip is configured to extend in a curvature from the first end to the second end to form an arced strip, which is configured to extend along a portion of a head of a user of the headband.

Action 720: A leg, e.g. a spring wire, of a rigid material is provided.

Action 730: The leg is engaged with the elongated strip to abut to the elongated strip and to extend along the elongated strip from the first end to the second end. In other words, an operator may put the leg into contact with the elongated strip such that the leg abuts the elongated strip and extends along the elongated strip from the first end to the second end thereof. Furthermore, the leg may advantageously be positioned along a center portion of the elongated strip.

Figure 7B:
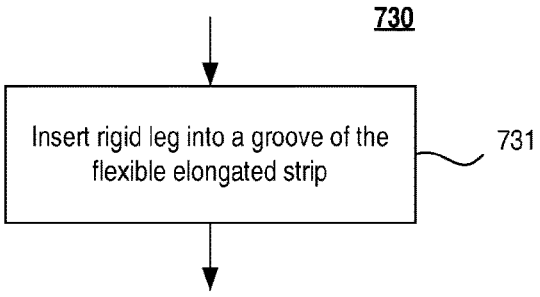
FIG. 7B is a flowchart of a sub-step, or action, of a method of providing a headband for a pair of headphones, in accordance with an embodiment.

Action 731: In an advantageous embodiment as illustrated in FIG. 7B, the elongated strip comprises a groove which extends from the first end to the second end. If so, the step, or action, of engaging the leg with the elongated strip comprises inserting the leg into the groove of the elongated strip.

Action 740: The method may also comprise attaching a first earpiece to the first end of the headband. Also, a second earpiece may be attached to the second end of the headband. During this step, or action, an audio cable (and/or other cable(s)) may also be provided. For example, an audio cable extending from the first earpiece may be inserted in a groove, or notch, at the first pivot hinge and be put along the flexible elongated strip and, further, inserted in a groove, or notch, at the second pivot hinge to connect to the second earpiece.

Action 750: Optionally, the method may also comprise attaching a headband cover to the headband. The headband may for example be irremovably attached to, or folded around, the headband. Alternatively, an interchangeable headband cover may be removably attached to, or folded around, the headband.

Figure 8:
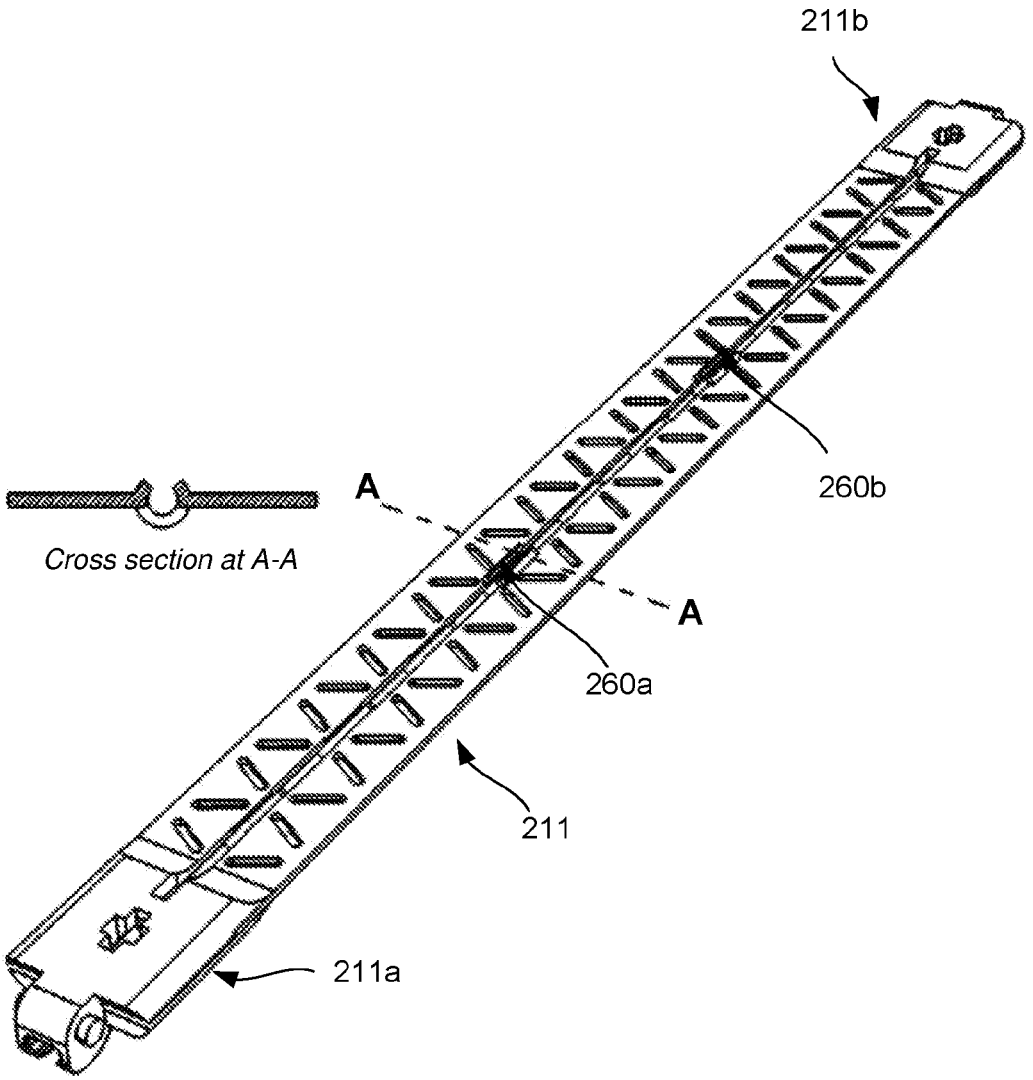
FIG. 8 schematically illustrates an embodiment of an elongated strip having a plurality of snap connections.
Figure 9:
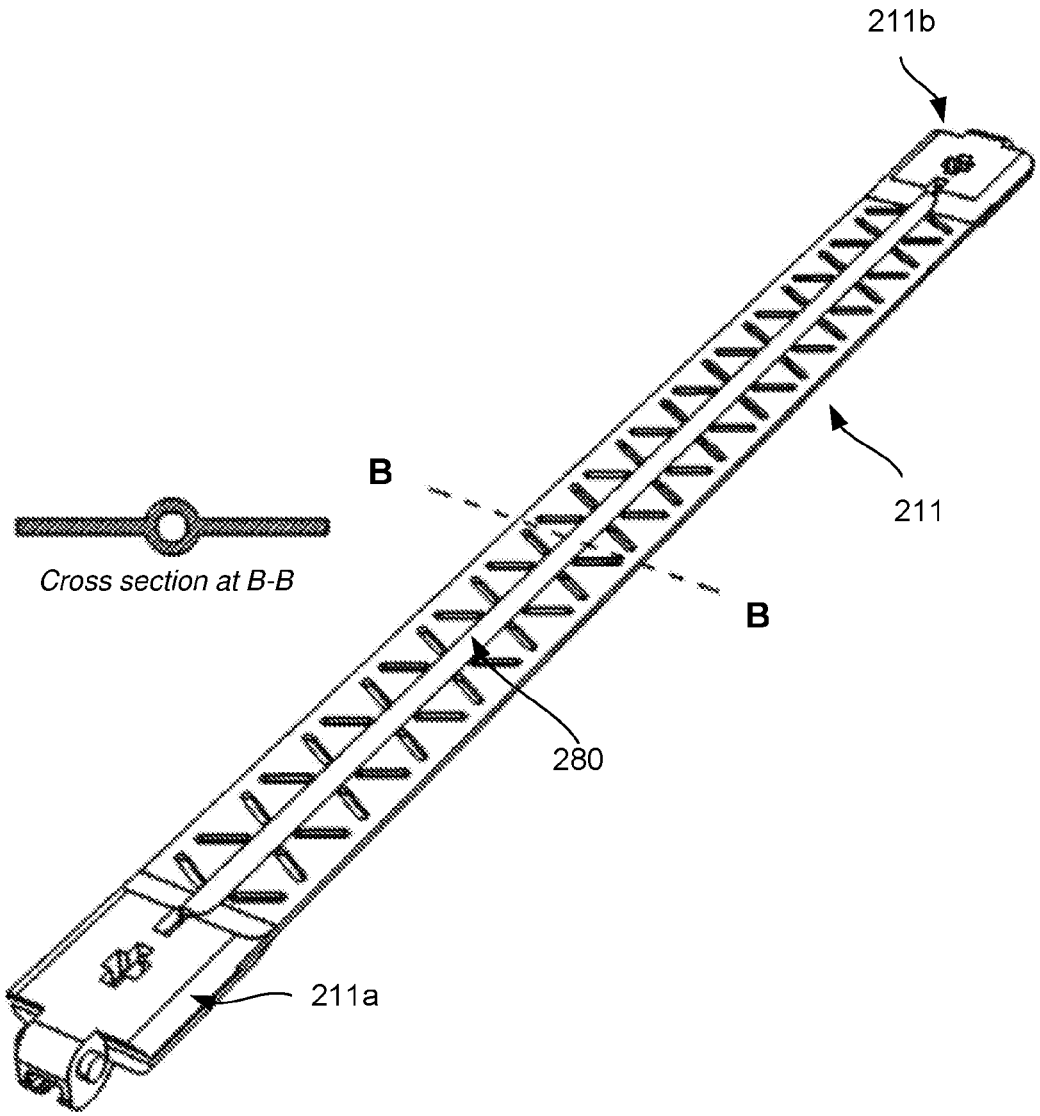
FIG. 9 schematically illustrates an embodiment of an elongated strip being provided with a tubular leg receiving means, or tube.
Figure 10:
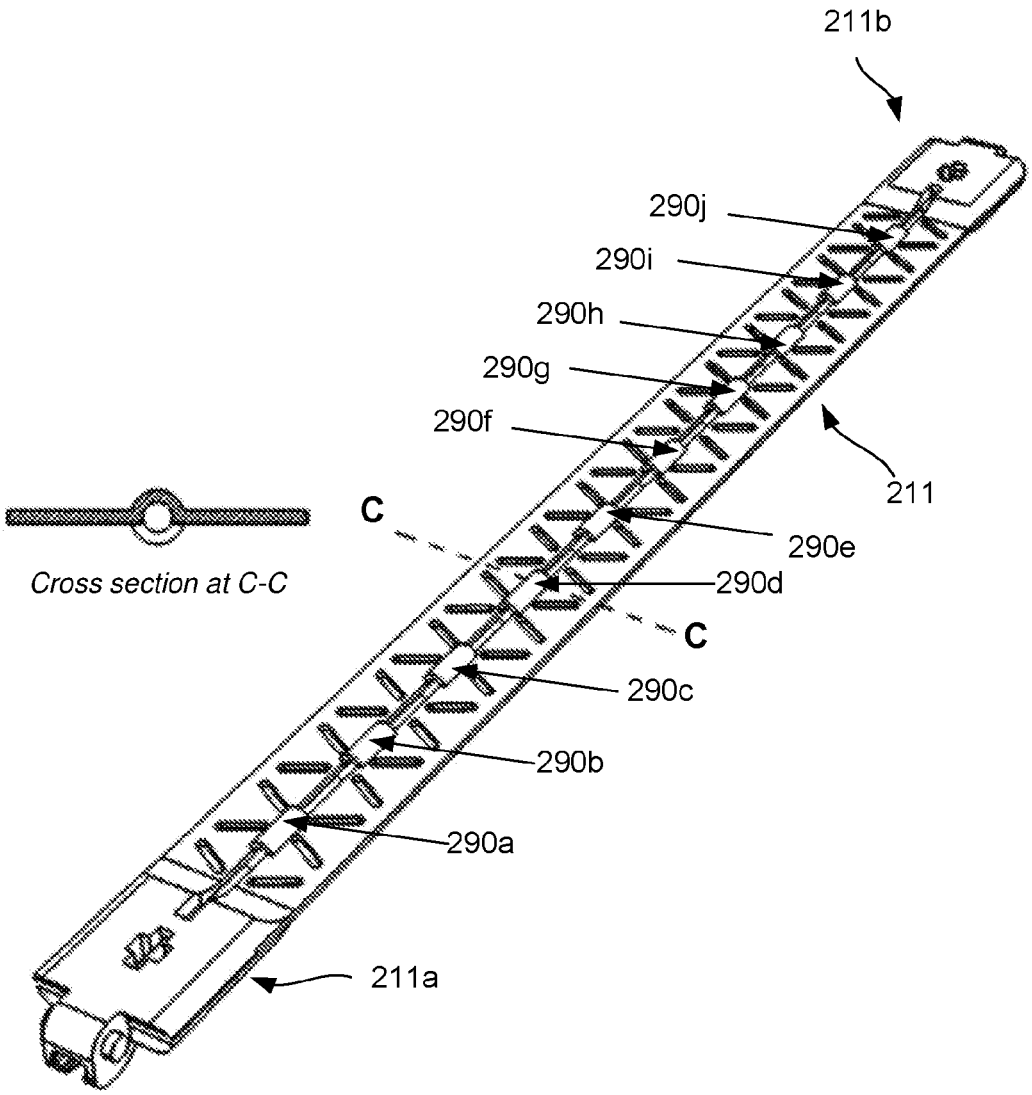
FIG. 10 schematically illustrates an embodiment of an elongated strip having a plurality of tubular section parts along a groove of the elongated strip.

Reference is now made to FIGS. 8 through 10, which schematically illustrate various advantageous embodiments of the elongated strip 211 described hitherto in this disclosure. As described earlier herein, the elongated strip 211 is made of a flexible material. Furthermore, the elongated strip comprises a first end 211*a* configured to be attached to a first earpiece 230*a* and a second end 211*b* configured to be attached to a second earpiece 230*b*. Still further, the elongated strip 211 is configured to extend in a curvature from the first end 211*a* to the second end 211*b* to form an arced strip 211. The arced strip 211 is configured to extend along a portion of a head of a user of the pair of headphones 200.

In FIGS. 8-10, the groove 250 is positioned along a center portion of the elongated strip 211. While it is advantageous to position, or locate, the groove 250 along a center portion of the elongated strip 211, this is however not necessary. A person skilled in the art would appreciate that it is not necessary to position the leg 220 at the exact center of the elongated strip 211. A certain deviation from the exact center of the elongated strip 211 is of course possible to achieve the same or similar effects with respect to the rotation of the flexible elongated strip 211 around the comparatively more rigid leg 220.

FIG. 8 illustrates an embodiment where one or several snap connections 260*a*; 260*b* are provided along the groove 250 of the elongated strip 211. This may have the effect of facilitating the insertion of the leg 220 in the groove 250. The provision of the one or several snap connections 260*a*; 260*b* along the groove 250 may also achieve good stability during the use of the headband.

FIG. 9 illustrates an embodiment where the leg 220 is enclosed by the elongated strip 211. For example, the elongated strip 211 may be provided with a tubular leg receiving means 280. The tubular leg receiving means 280 may sometimes be referred to as "tube" only. The tubular leg receiving means 280 is configured to receive the leg 220. In other words, the leg 220 may be inserted into the tubular leg receiving means 280. As can be seen in FIG. 9, the tubular leg receiving means 280 may be provided as one single tubular leg receiving means 280 extending from the first end 211*a* to the second end 211*b* of the elongated strip 211. The provision of the tubular leg receiving means 280 may achieve good stability during the use of the headband.

FIG. 10 illustrates yet another embodiment. In the embodiment disclosed in FIG. 10, a plurality of tubular section parts 290*a-j* is provided along the groove 250. Advantageously, but not necessarily, the elongated strip 211 comprises alternately reoccurring tubular section parts that collectively form a regular pattern along the groove 250. The provision of the plurality of tubular section parts 290*a-j* along the groove may facilitate the insertion of the leg 220 in the groove 250. The provision of the plurality of tubular section parts 290*a-j* along the groove 250 may also achieve good stability during the use of the headband.

The various embodiments described throughout this disclosure provide a headband for a pair of headphones, which is easy to adjust according to the size of a user's head and which, at the same time, will adjust itself to the shape of a user's head. The provision of a rigid leg abutting against a flexible elongated strip (e.g., inserted in a groove), for example, in a center portion thereof has the combined effect of enabling a sufficient clamp force to allow for pressing two earpieces properly against the ears of the user (in use) and, at the same, enabling a rotational movement of the elongated strip around the leg which in turn allows for a suitable adjustment to a user's head. In turn, this may provide a more comfortable and pleasant experience when using a pair of headphones.

LIST OF NUMBERED EXAMPLE EMBODIMENTS

The technology described in this disclosure thus encompasses without limitation the following Numbered Example Embodiments (NEE's):

NEE1. A headband 210 for a pair of headphones 200, the headband 210 comprising:

an elongated strip 211 made of a flexible material, wherein the elongated strip comprises a first end 211*a* configured to be attached to a first earpiece 230*a* and a second end 211*b* configured to be attached to a second earpiece 230*b*, and wherein the elongated strip 211 extends in a curvature from the first end 211*a* to the second end 211*b* to form an arced strip 211 which is configured to extend along a portion of a head of a user of the pair of headphones 200; and a leg 220 made of a rigid material, the leg 220 abutting against the elongated strip 211 and extending along the elongated strip 211 from the first end 211*a* to the second end 211*b* and wherein the leg 220 is positioned along a center portion of the elongated strip 211.

NEE2. The headband 210 according to NEE1, wherein the elongated strip 211 comprises a groove 250 which extends from the first end 211*a* to the second end 211*b* and wherein the leg 220 is insertable in the groove.

NEE3. The headband 210 according to NEE2, wherein one or several snap connections 260*a*; 260*b*; 260*c* are provided along the groove 250 to facilitate insertion of the leg 220 in the groove 250.

NEE4. The headband 210 according to NEE2 or NEE3, wherein the leg 220 is displaceable in a longitudinal direction of the elongated strip 211 at each of the first and second ends 211*a*; 211*b* such that the leg 220 is free to move back and forth within the respective end 211*a*; 211*b*.

NEE5. The headband 210 according to NEE4, wherein the groove 250 comprises a stop member 251*a*; 251*b* at each end of the groove 250.

NEE6. The headband 210 according to NEE1, wherein the leg 220 is attached to the elongated strip 211.

NEE7. The headband 210 according to NEE6, wherein the leg 220 is attached to the elongated strip 220 by means of an adhesive.

NEE8. The headband 210 according to NEE1, wherein the leg 220 is enclosed by the elongated strip 211.

NEE9. The headband 210 according to any one of the NEE's 1-8, wherein the leg 220 is a spring wire.

NEE10. The headband 210 according to any one of the NEE's 1-9, wherein the elongated strip 211 is made of a polymer material.

NEE11. A pair of headphones 200, comprising:

a headband 210 according to any one of the NEE's 1-10; wherein the first end 211*a* is attached to a first earpiece 230*a* and the second end 211*b* is attached to a second earpiece 230*b*.

NEE12. The pair of headphones 200 according to NEE11, wherein the first end 211*a* is attached to a first earpiece 230*a* by means of a first pivot hinge 240*a* and the second end 211*b* is attached to the second earpiece 230*b* by means of a second pivot hinge 240*b*, and wherein each pivot hinge 240*a*; 240*b* comprises a recess 241*b* configured to receive an audio cable such that the audio cable can extend from the first earpiece 230*a* along the elongated strip 211 to the second ear piece 230*b*.

NEE13. A method 700 of providing a headband for a pair of headphones, the method 700 comprising:

providing 710 an elongated strip made of a flexible material, wherein the elongated strip comprises a first end configured to be attached to a first earpiece and a second end configured to be attached to a second earpiece, and wherein the elongated strip extends in a curvature from the first end to the second end to form an arced strip which is configured to extend along a portion of a head of a user of the headband;

providing 720 a leg made of a rigid material;

engaging 730 the leg with the elongated strip such that the leg abuts to the elongated strip and the leg extends along the elongated strip from the first end to the second end and is further positioned along a center portion of the elongated strip.

NEE14. The method 700 according to NEE13, wherein the elongated strip comprises a groove which extends from the first end to the second end and wherein the engaging 730 of the leg with the elongated strip comprises:

inserting 731 the leg in the groove of the elongated strip.

Modifications and other variants of the described embodiments will come to mind to one skilled in the art having benefit of the teachings presented in the foregoing description and associated drawings. Therefore, it is to be understood that the embodiments are not limited to the specific example embodiments described in this disclosure and that modifications and other variants are intended to be included within the scope of this disclosure. For example, while embodiments of the invention have been described with reference to headbands for a pair of headphones, persons skilled in the art will appreciate that the embodiments of the invention may equivalently be applied to similar ear devices including, for example, ear protectors. Furthermore, although specific terms may be employed herein, they are used in a generic and descriptive sense only and not for purposes of limitation. Therefore, a person skilled in the art would recognize numerous variations to the described embodiments that would still fall within the scope of the appended claims. As used herein, the terms "comprise/comprises" or "include/includes" do not exclude the presence of other elements or steps. Furthermore, although individual features may be included in different claims (or embodiments), these may possibly advantageously be combined, and the inclusion of different claims (or embodiments) does not imply that a certain combination of features is not feasible and/or advantageous. In addition, singular references do not exclude a plurality. Finally, reference signs in the claims are provided merely as a clarifying example and should not be construed as limiting the scope of the claims in any way.

The invention claimed is:

1. A headband for a pair of headphones, the headband comprising:

an elongated strip made of a flexible material, wherein the elongated strip comprises a first end configured to be attached to a first earpiece and a second end configured to be attached to a second earpiece, and wherein the elongated strip is configured to extend in a curvature from the first end to the second end to form an arced strip which is configured to extend along a portion of a head of a user of the pair of headphones; and a leg made of a rigid material, the leg abutting against the elongated strip and extending along the elongated strip from the first end to the second end, wherein the elongated strip comprises a groove which extends from the first end to the second end and wherein the leg is inserted in the groove.

2. The headband of claim 1, wherein the groove is positioned along a center portion of the elongated strip.

3. The headband of claim 1, wherein one or several snap connections are provided along the groove to facilitate insertion of the leg in the groove.

4. The headband of claim 1, wherein the leg is displaceable in a longitudinal direction of the elongated strip at each of the first and second ends such that the leg is moveable within the respective end.

5. The headband of claim 4, wherein the groove comprises a stop member at each end of the groove.

6. The headband of claim 1, wherein the leg is enclosed by the elongated strip.

7. The headband of claim 6, wherein the elongated strip comprises a tubular leg receiver and wherein the leg is inserted into said tubular leg receiver.

8. The headband of claim 1, wherein a plurality of tubular section parts are provided along the groove.

9. The headband of claim 1, wherein the leg is a spring wire.

10. The headband of claim 9, wherein the spring wire comprises metal.

11. The headband of claim 10, wherein the spring wire comprises a steel alloy or an aluminum alloy.

12. The headband of claim 9, wherein the spring wire comprises glass fiber.

13. The headband of claim 9, wherein the spring wire comprises a combination of glass fiber and titanium.

14. The headband of claim 9, wherein the spring wire comprises carbon fiber.

15. The headband of claim 1, wherein the elongated strip is made of a polymer material.

16. A pair of headphones, comprising:

a headband according to claim 1; wherein the first end is attached to a first earpiece and the second end is attached to a second earpiece.

17. The pair of headphones of claim 16, wherein the first end is attached to a first earpiece by a first pivot hinge and the second end is attached to the second earpiece by a second pivot hinge, and wherein each pivot hinge comprises a recess configured to receive an audio cable such that the audio cable can extend from the first earpiece along the elongated strip to the second ear piece.

18. A headband for a pair of headphones, the headband comprising:

an elongated strip made of a flexible material, wherein the elongated strip comprises a first end configured to be attached to a first earpiece and a second end configured to be attached to a second earpiece, and wherein the elongated strip is configured to extend in a curvature from the first end to the second end to form an arced strip which is configured to extend along a portion of a head of a user of the pair of headphones; and a leg made of a rigid material, the leg abutting against the elongated strip and extending along the elongated strip from the first end to the second end, wherein the elongated strip comprises a groove which extends from the first end to the second end and wherein the leg is inserted in the groove, wherein a plurality of tubular section parts are provided along the groove, and wherein the elongated strip comprises alternately reoccurring tubular section parts that collectively form a regular pattern along the groove.

19. The headband of claim 18, wherein the groove is positioned along a center portion of the elongated strip.

20. The headband of claim 18, wherein one or several snap connections are provided along the groove to facilitate insertion of the leg in the groove.

* * * * *